United States Patent [19]

Raymond

[11] Patent Number: 4,878,540

[45] Date of Patent: Nov. 7, 1989

[54] APPARATUS AND PROCESS FOR PUMPING FLUID FROM SUBTERRANEAN FORMATIONS

[76] Inventor: William M. Raymond, P.O. Box 48788, Wichita, Kans. 67201

[21] Appl. No.: 210,701

[22] Filed: Jun. 22, 1988

[51] Int. Cl.[4] ..... E21B 43/12

[52] U.S. Cl. ..... 166/369; 166/62; 165/45; 417/406

[58] Field of Search ..... 166/57, 62, 68, 68.5, 166/165, 302, 369, 370; 165/45; 62/119; 417/375, 379, 405, 406, 408, 409

[56] References Cited

U.S. PATENT DOCUMENTS

| | | | |
|---|---|---|---|
| 2,444,754 | 7/1948 | Steffen | 166/62 |
| 2,914,124 | 11/1959 | Ripley, Jr. | 166/62 X |
| 4,076,466 | 2/1978 | Swanson, Jr. | 417/406 X |
| 4,154,297 | 5/1979 | Austin | 166/62 X |

*Primary Examiner*—William P. Neuder
*Attorney, Agent, or Firm*—John W. Carpenter

[57] ABSTRACT

Apparatus for pumping fluid from a subterranean reservoir. The apparatus has in combination a well casing and a hollow tube disposed concentrically within the well casing. Secured to the end of the hollow tube is a hollow housing which includes a motor and a pump driven by the motor. An entrance conduit extends down the annulus between the tubing and the casing and carries a refrigerant working fluid which drives the motor in order to operate the pump which pumps subterranean fluids from the housing through the hollow tubing up to the surface of the earth. A return conduit extends from the hollow housing through the hollow tubing up to the surface of the earth. After the refrigerant working fluid expands and drives the motor, it is initially cooled. Subsequently, the refrigerant working fluid passes into the top of the hollow housing where it is vaporized within the return conduit as the return conduit is in contact with hot subterranean produced formation fluids. The vaporized refrigerant rises in the returning conduit due to the difference in pressure from the bottom of the hole to the surface of the earth.

12 Claims, 3 Drawing Sheets

FIG. 3
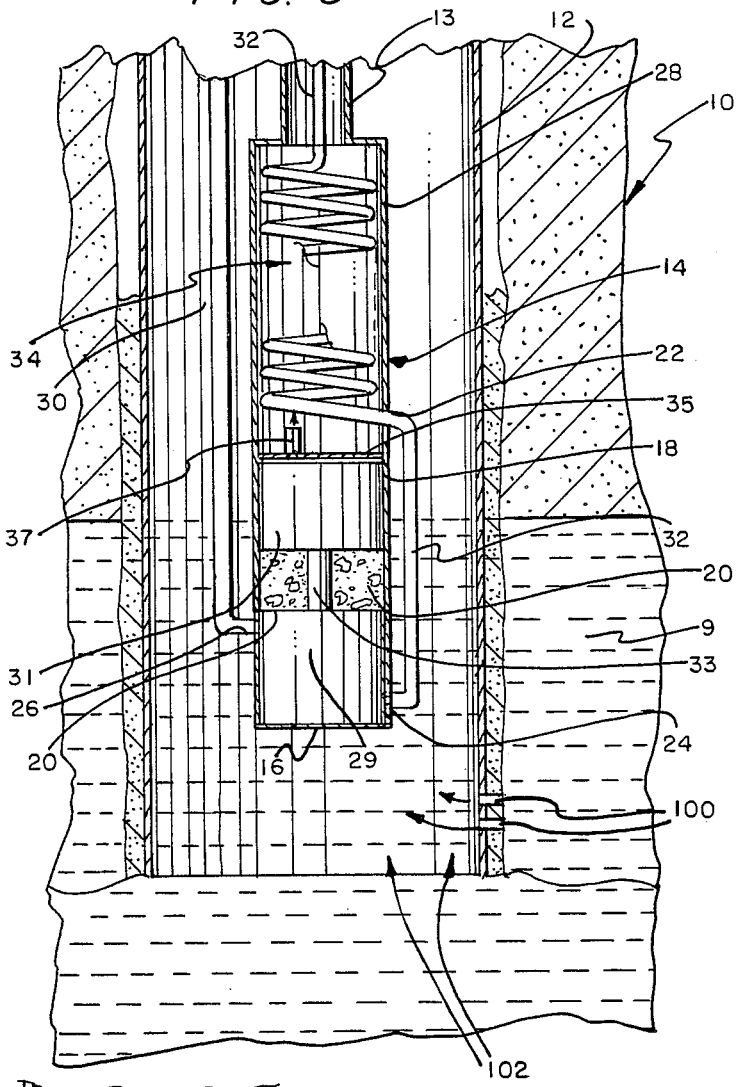
FIG. 4
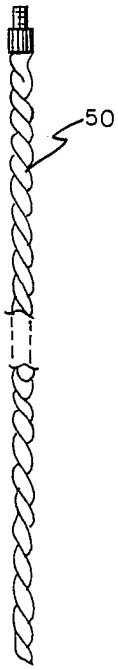
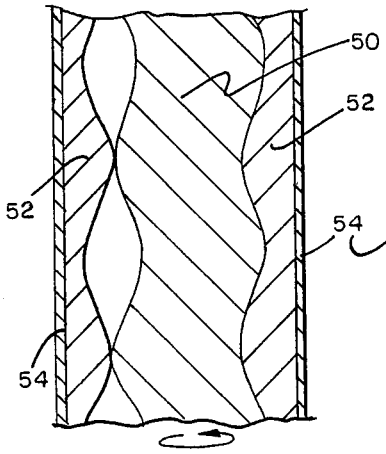
FIG. 5
FIG. 6
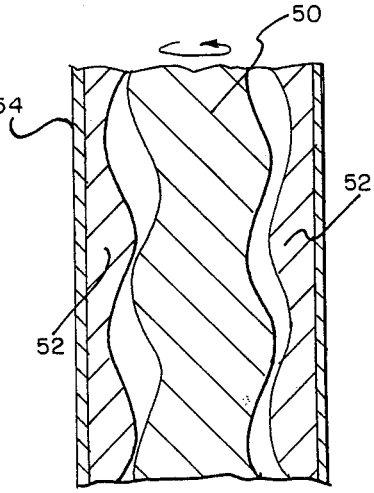
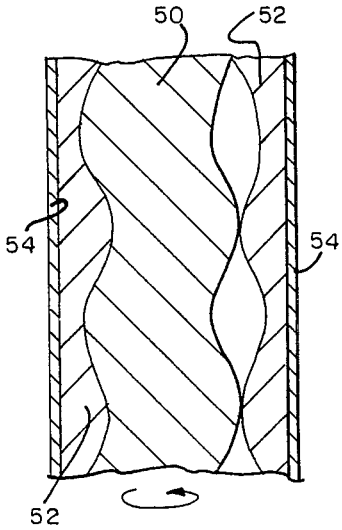
FIG. 7

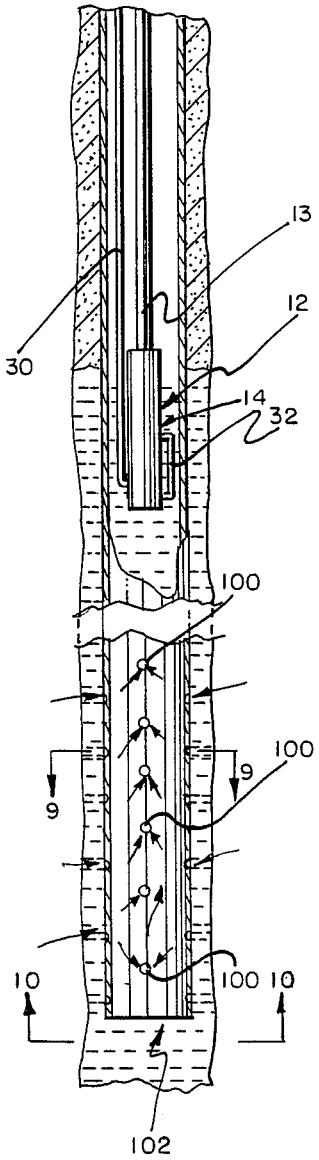
FIG. 8
FIG. 9
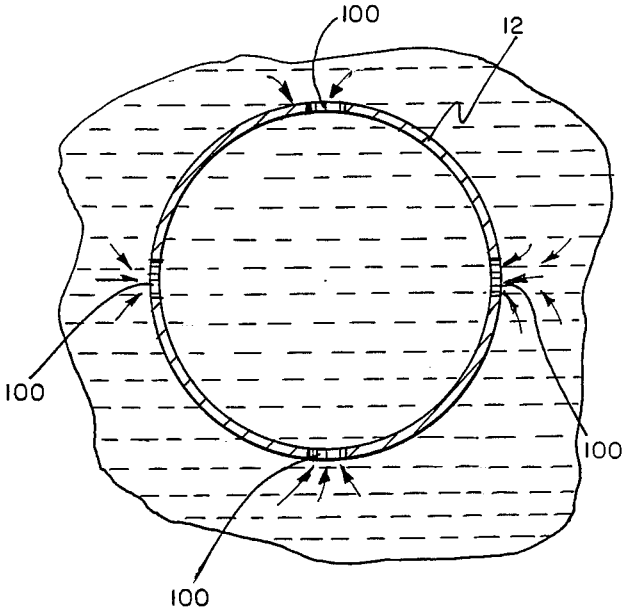
FIG. 10
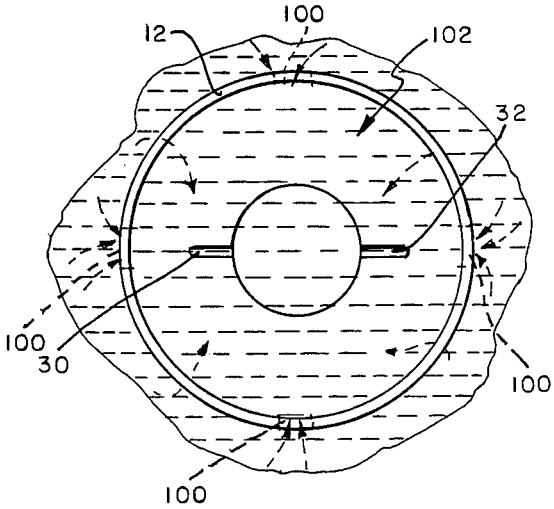

APPARATUS AND PROCESS FOR PUMPING FLUID FROM SUBTERRANEAN FORMATIONS

FIELD OF THE INVENTION

This invention relates to an apparatus and process for pumping oil, water, or any other subterranean fluid, from wells drilled into reservoirs beneath the surface of the earth. More specifically, this invention relates to an apparatus and process for pumping subterranean fluids from wells drilled into subterranean formations beneath the surface of the earth, which utilizes the elevation difference between the earth's surface and that of the reservoir, along with the temperature difference between the ambient air at the earth's surface and the warmer temperature of the subterranean fluids from the subterranean formation.

DESCRIPTION OF THE PRIOR ART

One of the current problems of the oil producing industry is the high cost of fuel for pumping oil from wells. There are hundreds of thousands of "stripper" oil wells in this country which operate at a small margin of profit. The main expense for pumping most of these wells is fuel. The recent decline in the world price for oil has rendered many of these wells unprofitable. Without a more efficient, less fuel costly means of pumping, they will be plugged and abandoned, resulting in the loss of their recoverable reserves. It has been discovered that temperature and elevation differences that exist in most deep wells could be utilized to create power to pump the wells, eliminating all or most of the fuel required with present pumping methods.

A patentability investigation was conducted on methods that employ temperature and elevation differences in transporting fluids, and the following patents were discovered: U.S. Pat. No. 4,187,686 to Pommier; U.S. Pat. No. 4,232,524 to Goyat; U.S. Pat. No. 3,953,971 to Parker; U.S. Pat. Nos. 4,342,197 and 3,898,020, both to Matthews; and U.S. Pat. No. 4,328,673, also to Matthews. The majority of the systems disclosed in those prior art references comprise a geothermal energy recovery apparatus making use of thermal energy stored by subterranean heat sources in hot, solute-bearing well water to generate vapor or superheated fluid from a surface-injected flow of a clean working liquid; heated fluid is then used to operate a turbine-driven pump within the well for pumping the hot brine at high pressure and always in liquid state to the earth's surface, where it transfers its heat in a binary, closed-loop, heat-exchanger turbine-alternator combination for generation of electrical power. Residual brine is pumped back into the earth, while the clean, cooled working liquid is condensed at the surface-located system and is returned continuously to the deep well pumping system for generating working vapor. None of the foregoing prior art patents teach or suggest the particular apparatus and method of this invention.

SUMMARY OF THE INVENTION

It is therefore an object of the present invention to provide an improved, more economical system for pumping fluids such as oil, water, or a combination thereof, from reservoirs in the subsurface of the earth, utilizing the elevation difference between the earth's surface and that of the reservoir, along with the temperature difference between the ambient air at the earth's surface and the warmer temperature of the fluids in the reservoir.

It is another object of the present invention to provide a well pumping system wherein a condenser is located at the surface of the earth with sufficient capacity, including mechanical chilling, if necessary, to convert a fluorocarbon vapor to a fluid.

It is yet another object of the present invention to provide a well pumping system wherein a vaporizer is located at the bottom of the well with sufficient capacity to cause the fluorocarbon liquid to boil off to a vapor.

It is still yet another object of the present invention to provide a well pumping system wherein a pump may be used, if necessary, to inject the fluorocarbon fluid down its conduit in the well bore to insure its maintaining a liquid state to the bottom of the hole.

The foregoing objects are accomplished by the practice of the present invention. Broadly, the present invention accomplishes its desired objects by providing a system that utilizes the elevation difference between the earth's surface and that of the reservoir, along with the temperature difference between the ambient air at the earth's surface and the warmer temperature of the fluids in the reservoir. The system utilizes a heat rejection apparatus such as a condenser located at the earth's surface which is cooled by the ambient air. A vaporizer, located at the bottom of the hole, supplies heat to the system utilizing the warmth of the fluid coming from the subsurface reservoir. A liquid fluorocarbon fluid, such as freon, flows from the surface condenser down a conduit to the bottom of an oil well at relatively high pressure where it drives a hydraulic motor which is connected to a pump by a shaft. The pump receives oil from the subsurface oil reservoir. The hydraulic motor drives the pump which sends the oil to the surface. The fluorocarbon fluid passes from the motor into a condenser which has heat supplied to it by the fluid being produced from the subsurface reservoir. The fluorocarbon fluid absorbs heat in the vaporizer and boils off to a vapor. The vapor then returns through a conduit to the condenser at the surface. The condenser cools the vapor, condensing it to a liquid, so that the process is started all over again. In some cases with the present invention, it may be desirable to extract heat from the vapor by the use of a chilling device to assist its return to a liquid state at the surface of the earth. In other cases, it may be desirable to add pressure to the liquid by means of a pump at the surface to be sure of its maintaining a liquid state as it flows to the bottom of the hole. Another aspect of this invention is to take advantage of the difference in hydrostatic pressure created by the various fluids in its system. Liquid fluorocarbon is heavier than either the oil or water that is to be produced from the subsurface reservoir. It therefore creates a greater hydrostatic pressure at the bottom of the hole furnishing a work advantage.

These, together with various ancillary objects and features which will become apparent to those skilled in the art as the following description proceeds, are attained by this novel apparatus and process for pumping fluid from subterranean formations, a preferred embodiment being shown with reference to the accompanying drawings, by way of example only, wherein:

DESCRIPTION OF THE DRAWINGS

FIG. 3 is a partial cross sectional view of the elements of the present invention below the surface of the earth in proximity to a producing oil formation;

FIG. 4 is a partial perspective view of a rotor which is driven by a hydraulic motor in order to assist in pumping produced oil;

FIG. 5 a partial vertical sectional view of the rotor rotatably within a double helix molded stator with one side of the helix rotor mating with the helix stator;

FIG. 6 a partial vertical sectional view of the rotor-stator of FIG. 5 with the rotor having been rotated a predetermined distance counter clockwise; and FIG. 7 partial vertical sectional view of the rotorstator of FIG. 6 with the rotor having been completely rotated counter clockwise such that the opposite side of the helix stator mates with the helix rotor.

FIG. 8 is a partial segmented cross sectional view of the elements of the invention in FIG. 3 more particularly depicting the perforated casing and the casing open at the bottom;

FIG. 9 is a horizontal sectional view taken in direction of the arrows and along the plane of line 9—9 in FIG. 8; and FIG. 10 is a horizontal view taken in direction of the arrows and along the plane of line 10—10 in FIG. 8.

DETAILED DESCRIPTION OF THE INVENTION

Figure 1:
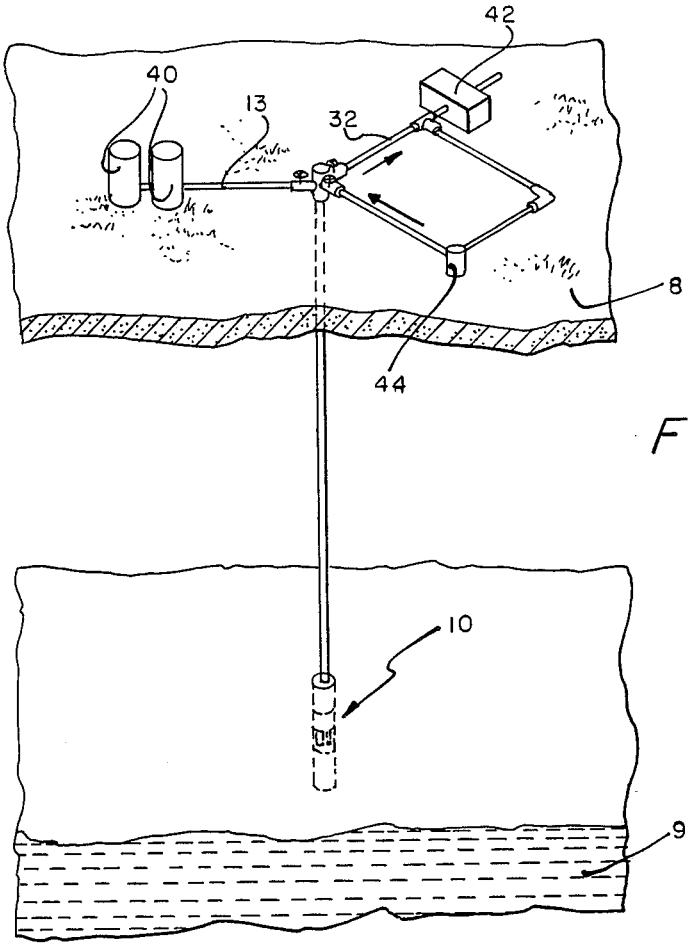
FIG. 1 is a perspective view of the present invention showing the relationship of the various components on the surface of the earth and beneath the surface of the earth in proximity to a subterranean formation.

Referring in detail now to the drawings, wherein similar parts of the invention are represented by like reference numerals, there is illustrated an oil well pumping system, generally illustrated as 10, embodying principals of the present invention. The system 10 is specifically designed to be utilized in wells drilled into reservoirs 9 beneath the surface 8 of the earth for the purpose of extracting oil, water, or a combination thereof. The drilling of these wells creates an elevation difference, which can be utilized along with a temperature differential to create a pumping system using little or no fuel. It is well known that the temperature of the earth increases with the depth to which it is penetrated. The temperature of fluids in subsurface oil reservoirs are directly affected by the temperature of the surrounding host rock. The increase of temperature with depth can be stated as follows: $Y=A+BX$, where $Y$ = the temperature of the earth in Fahrenheit at depth $X$ in feet, $A$ = the annual mean temperature of the earth at a point just below the surface 8, where it is not affected by the ambient air at the surface 8, and $B$ = the temperature gradient in feet per degree Fahrenheit. An example of this would be a well in western Kansas where $A=55°$ F., the temperature of the earth just below the surface 8, $B=0.014$, the measured gradient for the area in degrees Fahrenheit per foot of depth, and $X=4{,}600$ feet, the depth of the subsurface reservoir 9 in the well. Substituting the appropriate values into $Y=A+BX$, Y would equal $55°$ F. $+(0.014\times4{,}600)=119°$ F. The temperature of the ambient air ranges from below freezing at times in winter to about 100° F. in summer, with an annual mean temperature of about 60° F. Hundreds of thousands of existing wells have similar temperature and elevation differences.

Referring now to FIG. 3, there is seen the oil well pumping system 10 for pumping fluid (e.g. oil, water, or any other subterranean fluid) from a subterranean formation, such as reservoir 9. The system 10 has a casing 12 which extends from the surface 8 of the earth down to the subterranean reservoir 9. A hollow tubing 13 is concentrically disposed within the well casing 12. The tubing 13 extends down to a location that is in close proximity to the subterranean reservoir 9. Secured to the bottom of the tubing 13 is a cylindrical hollow housing, generally illustrated as 14. The hollow housing 14 is hollow and communicates with the tubing 13 such that any subterranean fluid passing through the housing and the pump can enter the hollow tubing 13. The cylindrical housing 14 has a larger diameter than the diameter of the hollow tubing 13. As best illustrated in FIGS. 3, 8–10, fluids from a subterranean formation enter well casing 12 through casing perforations 100 positioned through the casing 12 or through an open ended bottom of the casing 12, generally illustrated as 102.

Housing 14 comprises a bottom 16, a side 18, and an upper part 28. As best illustrated in FIG. 3, the cylindrical hollow housing is generally concentric with the hollow tubing 13. Part of the side 18 of the housing 14 has a plurality of perforations 20. These perforations 20 provide a passageway for subterranean fluids leaving the reservoir 9. As the fluids are produced from the reservoir 9, they pass through the perforations 20 into the inside of the housing 14.

A hydraulic motor 29 is positioned at the bottom 16 of the hollow housing 14. A pump 31 is positioned within the hollow housing 14 above the hydraulic motor 29 such that the perforations 20 in the side 18 of the housing 14 separate the hydraulic motor 29 from the pump 31.

Figure 2:
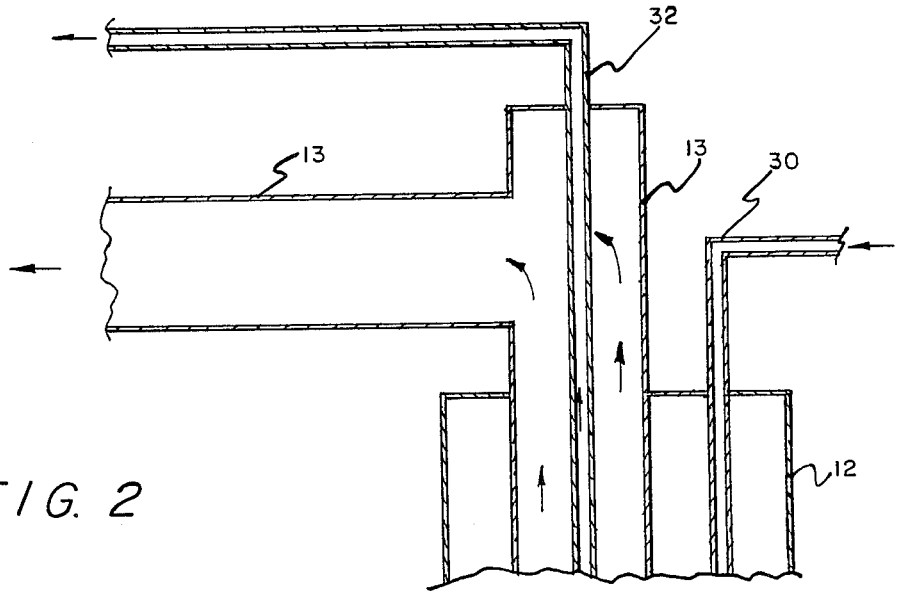
FIG. 2 is a partial cross sectional view of a well head showing the relationship of exiting crude oil and exiting refrigerant and entering liquid refrigerant working fluid.

A common shaft 33 is connected to the hydraulic motor 29 and the pump 31. The common shaft 33 transfers rotary power from the hydraulic motor 29 to the pump 31. A partition 35 is positioned within the housing 14 above the pump 31. The partition is secured to the wall 18, and has an aperture 37 wherethrough fluids are pumped by the pump 31 in order to enter the upper part 28 of the hollow housing 14. A conduit 30 extends from the surface 8 of the earth down to the hydraulic motor 29 and passes through the side 18 of the housing 14 at 26 in order to connect with the hydraulic motor 29. As illustrated in FIGS. 2 and 3, the conduit 30 is disposed between the casing 12 and the hollow tubing 13. Conduit 30 carries or transports a refrigerant working fluid. The refrigerant working fluid may be any suitable refrigerant fluid which accomplishes its purpose and functions within the spirit and scope of the present invention. Preferably, the refrigerant working fluid is selected from the group consisting of ammonia, sulfur dioxide, carbon dioxide, fluorinated hydrocarbon, chlorinated hydrocarbon, brominated hydrocarbon, fluorochloro hydrocarbon, fluorobromo hydrocarbon, light fraction hydrocarbon, lower alcohol, lower thioalcohol, lower alkylether, lower alkylthioether, alkylsulfoxide, toluene, xylene, and mixtures thereof. More preferably, the refrigerant working fluid is any fluid that is commonly known as "Freon".

A return conduit 32 extends from the hydraulic motor 29, through side 18 at 24, up the annular space between the housing 14 and the casing 12 (see FIG. 3), and through the side 18 of the housing 24 at 22 where it enters the upper portion 28 of the housing 14. Location 22 at the side 18 of the housing 14 is above the partition 35. The return conduit 32 forms a helical shaped structure, generally illustrated as 32, in the upper portion of the housing 14. This helical shaped structure 34 defines a heat exchange means that when refrigerant working fluid passes through the helical shaped structure, the heat from the subterranean fluids that are pumped 31 through aperture 37 vaporizes or boils the refrigerant working fluid into a vapor state. After the return conduit 32 has formed the helical structure 34, it continues generally concentric up the hollow wall tubing 13 to the surface of the earth 8 where, as illustrated in FIG. 2, it leaves hollow tubing 13.

Tubing 13 (as illustrated in FIG. 1) leads to oil storage tanks 40 and conducts or carries subterranean produced oil (or any other subterranean fluid) to the tanks 40 for storage. Return conduit 32 extends to a condenser 42 where refrigerant vapors are cooled and condensed into a refrigerant liquid. After the refrigerant vapor is condensed into a liquid state by the condenser 42, it is transported to a pump 44 which pumps the refrigerant fluid through conduit 30 down to the hydraulic motor 29. Between the pump 44 and the condenser 42 may be a refrigerant storage tank (not shown in the drawings). The storage tank may provide a reservoir for storing refrigerant working fluid. There should be provided a sufficient quantity of refrigerant working fluid to fill the conduit 30 with refrigerant fluid and the return conduit 32 with vapor. A sufficient quantity of refrigerant working fluid should also be provided for changes in the ratio of fluid to gas due to fluctuation of pressures and temperatures in the system 10 which may be caused by variation of the ambient air flowing through the condenser 42.

As the refrigerant working fluid descends through conduit 30 between the well tubing 13 and the casing 12, it is in a liquid state and is gradually being heated due to the change in temperature as the conduit goes deeper down below the surface 8 of the earth. The refrigerant working fluid passes through the side 18 at location 26 where it enters into the hydraulic motor 29, causing the motor 29 to turn and impel rotary power on the common shaft 33. As was indicated, hydraulic motor 29 drives the pump 31 which receives oil, or any other subterranean fluid, from the reservoir 9 through the perforations 20 in the side 18 of the housing 14. The pump 31, a preferred embodiment being discussed below, drives the oil to the surface 8 of the earth where it flows into the storage tanks 40.

The hydraulic motor is an expansion means in the sense that there is a pressure drop between the location 26 and the location 24 on the side 18 of the housing 14. This expansion causes the refrigerant working fluid to cool in the lower part of the housing 14. The cooled refrigerant working fluid is passed through the side 18 at the location 24 and enters into return conduit 32 that extends from hydraulic motor 29 through the annulus between the casing 12 and the housing 14, and through the side 18 at location 22 to enter the upper portion 28 of the housing 14. As the cooled refrigerant working fluid passes through return conduit 32 between the side 18 of the housing 14 and the casing 12, it begins to be heated from the subterranean atmosphere, including any heated subterranean fluids that may come in contact with the return conduit 32. The amount of heat imported to the cooled refrigerant working fluid as it flows through this section of return conduit 32 depends on a number of variables, such as the flow rate of the cooled refrigerant fluid, the temperature of the surrounding subterranean atmosphere, the structure of the return conduit, etc.

After leaving the section of the return conduit 32 that is situated between the housing 14 and the casing 12, the refrigerant working fluid enters the helical structure (or vaporizer) section of the return conduit 32. As was indicated, the helical structure 34 is situated in the upper portion 28 of the hollow housing 14 and the circuitous structure enables the refrigerant working fluid to remain in contact with the subterranean fluid that is being pumped by pump 31 through aperture 34 into the upper portion 28 of the housing 14. The heat of the subterranean fluid causes the refrigerant working fluid to start vaporizing within the helical structure 34. After the refrigerant working fluid is vaporized, it ascends within the return conduit 32 within the well tubing 13. Heated subterranean fluid is in continuous contact with conduit 32 as conduit 32 leaves the hollow housing 14 to ascend to the surface 8 of the earth. This heat causes the vaporized refrigerant working fluid to remain in a vapor state while it rises within return conduit 32 to the surface 8 of the earth. As is readily apparent, the produced subterranean fluid travels in the same direction within the well tubing 13 as the vaporized refrigerant that ascends within return conduit 32. As the refrigerant working fluid is being vaporized within the helical structure 34, its hydrostatic pressure from its fluid state is released because the fluid refrigerant liquid is being vaporized into a gas where it returns through return conduit 32 to the surface 8 of the earth in order to enter the condenser 42.

The pump 31 of this invention may be any suitable pump that is capable of performing the appropriate functions in accordance with the features of the invention. Preferably, the pump 31 is of the type having only two components producing a progressing cavity application. Therefore, the pump 31 comprises a rotor 50 and a stator 52 that is encapsulated or circumscribed by a tube 54. The rotor 50 is the only moving part and is preferably a single external helix with a round cross section. The stator 52 is a double internal helix that is preferably precision molded of synthetic elastomer that is permanently bonded within the steel tube 54. When the rotor 50 turns within the stator 52, cavities form as is illustrated in FIGS. 5, 6, and 7. The cavities progress from the bottom of the pump 31 which may be defined as the suction end to the top of the pump 31 which may be defined as the discharge end. As the cavities progress from the bottom to the top, they carry subterranean formation fluids up through the pump 31 and into the upper section 28 of the housing 14. The progressing cavities produce an effect like a rod pump that is continually on the up-stroke. The tight seals that are produced as the rotor 50 rotates within the stator 52 are created as the rotor helices and the stator helices alternate between mating positions and keep the subterranean formation fluids rising at a fixed rate, proportional to the rotational speed of the rotor 50. The progressing cavity pump 31 may be any suitable pump 31 employing a rotor 50/stator 52, such as that purchased from the Robbins and Meyers Co. under the registered trademark MOYNO.

My invention will be illustrated by the following set-forth example which is given by way of illustration and not by any limitation. All parameters such as temperatures, pressures, etc., submitted in this example are not to be construed to unduly limit the scope of my invention.

EXAMPLE

The pressure and temperature for the process for pumping fluid from the subterranean reservoir 9 may be any suitable temperatures and pressures within the confines of the physical properties (i.e., boiling temperatures/pressures, condensing temperatures/pressures, etc.) of the refrigerant working fluid which may be any suitable refrigerant including, but not limited to, dichlorodifluoromethane ($CCl_2F_2$, Freon-12), $C_2Cl_2F_4$ (Freon-114), $CCl_3F$ (Freon-11), $C_2Cl_3F_3$ (Freon-113), $SO_2$, $CO_2$, ammonia, and mixtures thereof. For the purposes of this example it will be assumed the liquid refrigerant leaving the condenser 42 has a pressure of 0.30 psia and a temperature of 60° F. and a flow rate of 100 mol/hour (or 14,892 pounds per hour). The liquid refrigerant chosen is Freon 13Bl which has a molecular weight of about 148.92 and a density of 63.95 pounds/cubic foot. After the liquid refrigerant is pressurized by pump 44 to a pressure of 400 psia, it has a temperature of 60.2° F. and a density of 65.03 pounds/cubic foot. As the liquid refrigerant is pumped down conduit 30 to an assumed depth of 4,600 feet, the pressure increases since the head pressure of the column of liquid refrigerant increases with depth. The pressure in conduit 30 at location 26 where the pressurized liquid refrigerant is about to enter housing 14 is about 2,400. The temperature of the liquid refrigerant at this pressure is about 121° F., and the refrigerant has a density of about 70.7 pounds per cubic foot. As the liquid refrigerant draws the hydraulic motor 29, an expansion of the liquid refrigerant within the motor 29 occurs. This expansion has a cooling effect on the liquid refrigerant. The expansion causes a change of pressure of the liquid refrigerant from about 2,400 psia to about 150 psia. The cooling effect is from about 121° F. to about 30° F. At these conditions of temperature an pressure, the refrigerant is still in a liquid state. When the liquid refrigerant is in the vaporizer (or helical structure 34), the vaporizer comes in contact with 130° F. crude oil which heats the liquid refrigerant to a temperature of about 88° F., causing the liquid refrigerant to vaporize into a gaseous state with an accompanying pressure drop to about 38 psia. The gaseous Freon ascends to the surface 8 of the earth within return conduit 32 due to pressure between the pressure (i.e., about 3.8 psia) at the location of the vaporizer (or helical structure 34) and the pressure (i.e., about 38 psia) within the return conduit 32 on the surface of the earth where the gaseous Freon enters the condenser 42 to cool or chill the gaseous Freon into a liquid state to start the process all over.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. An apparatus for pumping fluid from a subterranean reservoir comprising:

(a) a well casing means extending from a surface of the earth down to a subterranean reservoir, said well casing means having at least one casing perforation wherethrough fluid enters therein from said subterranean reservoir;

(b) a hollow tubing means having a known tubing diameter and disposed generally concentrically within said well casing means down to a predetermined depth;

(c) a generally cylindrical hollow housing having a housing diameter and a housing side wall is secured to the bottom of said hollow tubing means and is generally concentric therewith;

(d) a motor means disposed at the bottom of said hollow housing;

(e) a pump means disposed within said hollow housing above said motor means;

(f) a common shaft means connected to said motor means and said pump means for interconnecting the motor means with the pump means such that the shaft means can transfer rotary power from the motor means to the pump means, said housing side wall immediately opposed to said common shaft means having a structure defining a plurality of apertures wherethrough subterranean fluids pass;

(g) a partition means disposed within said hollow housing above said pump means, said partition having a partition aperture wherethrough subterranean fluids are pumped by said pump means;

(h) an entrance conduit means extending from the surface of the earth down to the motor means and through the housing side wall in order to connect with the motor means, said entrance conduit means being disposed between said well casing means and said hollow tubing means; and (i) a return conduit means extending from said motor means, through the housing side wall, upwardly between the housing side wall and said wall casing means, through the housing side wall above said partition means, and through the hollow housing above said partition means, and through the tubing means to the surface of the earth.

2. The apparatus of claim 1 wherein said pump means comprises a rotor rotatably disposed within a stator means, said rotor having a structure defining a single external helix.

3. The apparatus of claim 2 wherein the known tubing diameter is smaller than the housing diameter.

4. The apparatus of claim 3 wherein the return conduit means passing through said hollow housing above said partition means has a helical disposition.

5. A process for pumping fluid from a subterranean reservoir to a surface of the earth comprising the steps of:

(a) descending a refrigerant working fluid between a well casing means and a well tubing means;

(b) passing the refrigerant working fluid into a lower part of a housing secured to the bottom of the well tubing means;

(c) cooling the refrigerant working fluid in the lower part of the housing;

(d) passing the cooled refrigerant working fluid of step (c) out of the lower part of the housing;

(e) heating the cooled refrigerant working fluid of step (d);

(f) passing the heated refrigerant working fluid of step (e) into an upper part of the housing, said refrigerant working fluid of steps (a)–(e) being at a pressure and temperature such as to be in a liquid state;

(g) heating the heated refrigerant working fluid of step (f) in the upper part of the housing in order to vaporize the refrigerant working fluid into a vapor; and (h) ascending the vapor of step (g) through the well tubing means to the surface of the earth.

6. The process of claim 5 additionally comprising condensing the vapor of step (h) on the surface of the earth into the refrigerant working fluid.

7. The process of claim 6 additionally comprising producing a subterranean fluid through perforations in the housing above the location where the refrigerant working fluid of step (b) is passed into the housing.

8. The process of claim 7 additionally comprising pumping the subterranean fluid from a location in the housing above the location where the subterranean fluid is produced through the perforations in the housing and below the locations in the housing where the heated refrigerant working fluid of step (f) is passed into the upper part of the housing.

9. The process of claim 8 wherein said heating step (g) comprises employing the subterranean fluid.

10. The process of claim 9 additionally comprising flowing the subterranean fluid through the well tubing means in the same direction that said vapor of step (h) ascends.

11. The process of claim 10 additionally comprising heating the refrigerant working fluid of step (a) as it descends.

12. The process of claim 11 wherein said refrigerant working fluid is selected from the group consisting of sulfur dioxide, carbon dioxide, fluoronated hydrocarbon, chlorinated hydrocarbon, brominated hydrocarbon, fluorochloro hydrocarbon, fluorobromo hydrocarbon, light fraction hydrocarbon, lower alcohol, lower thioalcohol, lower alkyl ether, lower alkylthioether, alkylsulfoxide, toluene, xylene, and mixtures thereof.

* * * * *